US008032038B2

(12) United States Patent
Ushikubo

(10) Patent No.: US 8,032,038 B2
(45) Date of Patent: Oct. 4, 2011

(54) DEVELOPING DEVICE AND IMAGE FORMING APPARATUS

(75) Inventor: Junichi Ushikubo, Tokyo (JP)

(73) Assignee: Oki Data Corporation, Tokyo (JP)

( * ) Notice: Subject to any disclaimer, the term of this patent is extended or adjusted under 35 U.S.C. 154(b) by 708 days.

(21) Appl. No.: 12/149,818

(22) Filed: May 8, 2008

(65) Prior Publication Data

US 2008/0286005 A1 Nov. 20, 2008

(30) Foreign Application Priority Data

May 16, 2007 (JP) ..... 2007-129977

(51) Int. Cl.
*G03G 15/08* (2006.01)

(52) U.S. Cl. ..... 399/27; 399/258

(58) Field of Classification Search ..... 399/61
See application file for complete search history.

(56) References Cited

U.S. PATENT DOCUMENTS 5,587,770 A * 12/1996 Jo et al. ..... 399/27
6,337,956 B1 * 1/2002 Sato et al. ..... 399/27

FOREIGN PATENT DOCUMENTS

JP 2000231524 A * 12/1999
JP 2003-162138 6/2003

* cited by examiner

*Primary Examiner* — David Gray
*Assistant Examiner* — Roy Y Yi
(74) *Attorney, Agent, or Firm* — Kubotera & Associates, LLC

(57) ABSTRACT

A developing device includes a storage portion for retaining developer; a light guide member for forming a plurality of optical paths passing through the storage unit to detect an amount of the developer in the storage portion; a plurality of window members formed in a wall of the storage portion for passing the optical paths therethrough; a blocking member disposed to be movable for blocking the window members; and a drive unit for moving the blocking member. The blocking member is disposed on each of the optical paths. When the drive unit moves the blocking member, the blocking member periodically blocks and opens each of the optical paths in a specific cycle.

12 Claims, 16 Drawing Sheets

DEVELOPING DEVICE AND IMAGE FORMING APPARATUS

BACKGROUND OF THE INVENTION

The present invention relates to a developing device and an image forming apparatus.

A conventional developing device is used in an image forming apparatus such as a printer, a copier, and the likes. In the conventional developing device, an optical detection unit is provided for detecting a remaining amount of toner stored in a storage unit as developer. In this case, a transparent window member is disposed in a wall of the storage unit retaining toner, so that a remaining amount of toner is detected using light passing through the window member (refer to Patent Reference).

Patent Reference Japan Patent Publication No. 2003-162138

In the conventional developing device, a remaining amount of toner is detected at one point in the storage unit. Accordingly, when toner has an uneven distribution in the storage unit depending on a pattern of an image to be formed, it is difficult to accurately detect a remaining amount of toner.

In order to securely prevent toner from being supplied to a developing roller even in a case of an insufficient amount of toner, it is arranged to detect a remaining amount of toner with a certain margin, considering a situation in which a remaining amount of toner is not accurately detected. Accordingly, a toner cartridge is prompted to replace at a relatively early stage. As a result, even though a toner cartridge still retains a sufficient amount of toner, the toner cartridge is replaced with new one, thereby wasting toner.

In view of the problem described above, an object of the invention is to provide a developing device and an image forming device, in which it is possible to solve the problems of the conventional developing device. The developing device includes a plurality of window members disposed on a plurality of optical paths for detecting a remaining amount of toner. Further, a cleaning unit is provided for periodically cleaning the window members in cycles shifted by a specific phase. Accordingly, even when toner retained in a storage unit has an uneven distribution, it is possible to accurately detect a remaining amount of toner, thereby conserving toner.

Further objects of the invention will be apparent from the following description of the invention.

SUMMARY OF THE INVENTION

In order to attain the objects described above, according to the present invention, a developing device includes a storage portion for retaining developer; a light guide member for forming a plurality of optical paths passing through the storage unit to detect an amount of the developer in the storage portion; a plurality of window members formed in a wall of the storage portion for passing the optical paths therethrough; a blocking member disposed to be movable for blocking the window members; and a drive unit for moving the blocking member. The blocking member is disposed on each of the optical paths. When the drive unit moves the blocking member, the blocking member periodically blocks and opens each of the optical paths in a specific cycle.

In the present invention, the developing device includes the window members disposed on the optical paths for detecting a remaining amount of toner. Further, the blocking member is provided for periodically blocking and opening each of the optical paths in a specific cycle. Accordingly, even when toner retained in the storage portion has an uneven distribution, it is possible to accurately detect the remaining amount of toner, thereby conserving toner.

DETAILED DESCRIPTION OF THE PREFERRED EMBODIMENTS

Hereunder, embodiments of the present invention will be described in more detail with reference to the accompanying drawings.

First Embodiment

Figure 2:
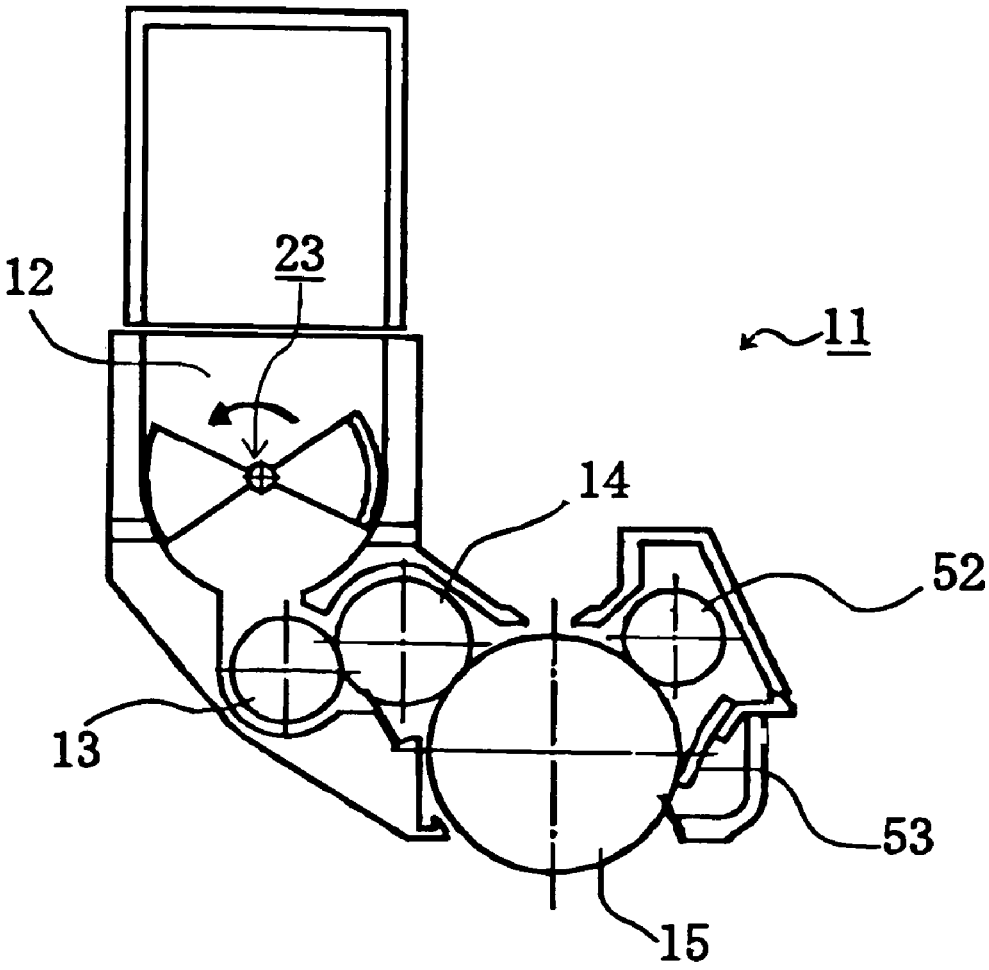
FIG. 2 is a schematic side sectional view showing the developing device according to the first embodiment of the present invention.
Figure 3:
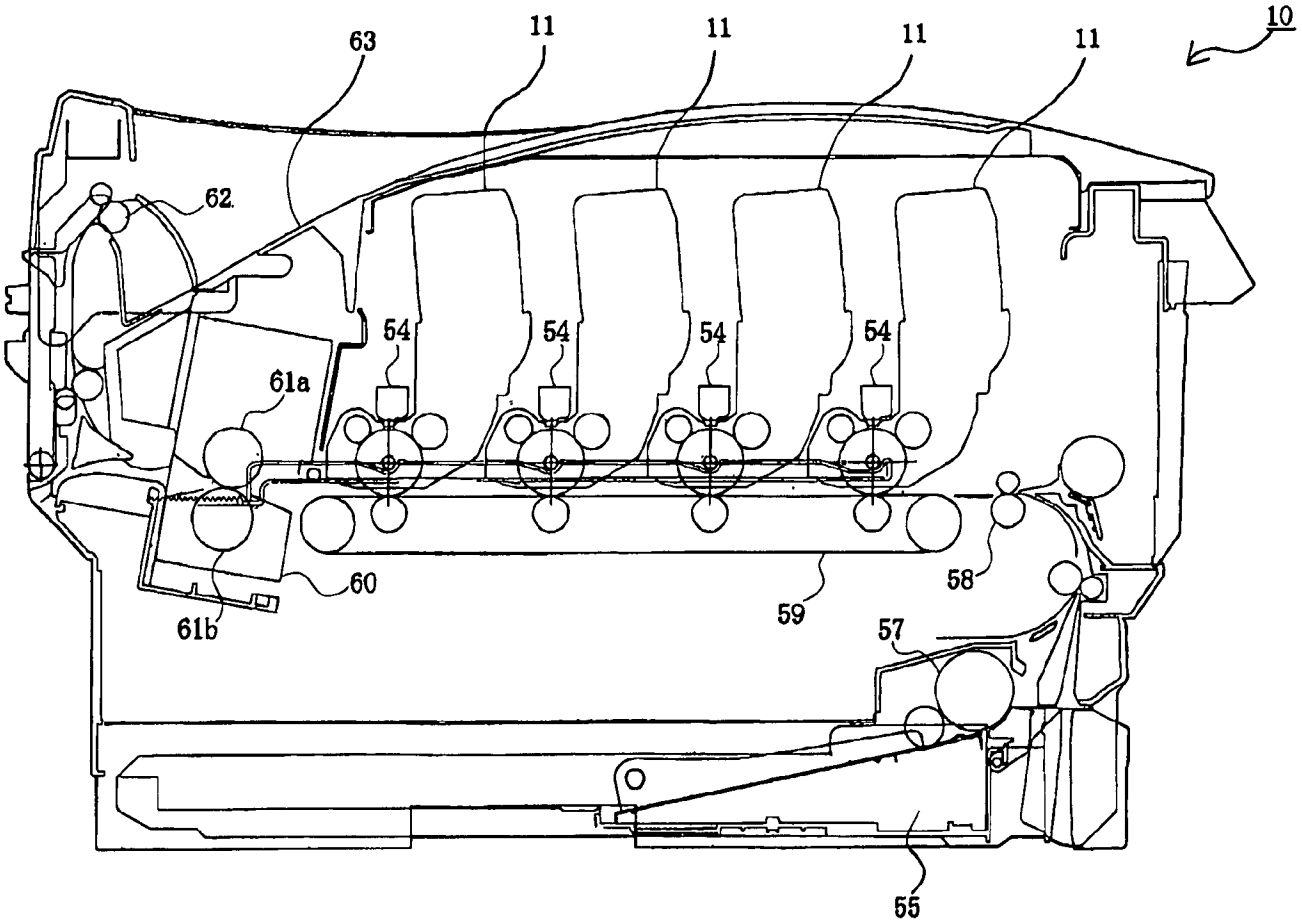
FIG. 3 is a schematic sectional view showing an image forming apparatus according to the first embodiment of the present invention.

A first embodiment of the present invention will be explained. FIG. 2 is a schematic side sectional view showing a developing device 11 according to the first embodiment of the present invention. FIG. 3 is a schematic sectional view showing an image forming apparatus 10 according to the first embodiment of the present invention.

In the embodiment, the image forming apparatus 10 may be any type of image forming apparatus such as a printer of an electro-photography type, a facsimile, a copier, and a multi-function printer having functions of a printer, a facsimile, and a copier. In the following description, the image forming apparatus 10 is a tandem type color printer of an electro-photography type.

As shown in FIG. 3, in the image forming apparatus 10, the developing devices 11 corresponding to four colors, i.e., cyan (C), magenta (M), yellow (Y), and black (K), respectively, are arranged sequentially along a transportation path of a medium in a direction that the medium is transported (to the left side in FIG. 3). The developing devices 11 have an identical configuration and retain toner 30 of different colors.

In the embodiment, the image forming apparatus 10 includes a medium tray 55 for storing the medium as a recording sheet; a sheet supply roller 57 for separating and supplying the medium one by one from the medium tray 55; a transportation roller 58 for transporting the medium thus supplied; and a transfer belt 59 for transporting the medium and transferring a toner image to the medium. When the transportation roller 58 transports the medium to the transfer belt 59, static charge is applied to the medium to be attached to the transfer belt 59. Afterward, while the developing devices 11 form the toner image, the transfer belt 59 transports the medium.

In the embodiment, the image forming apparatus 10 further includes a fixing unit 60 as a fixing device for fixing the toner image thus transferred to the medium through heat and pressure. The fixing unit 60 includes a pressing roller 61*a* and a heating roller 61*b*. The image forming apparatus 10 further includes a discharge roller 62 for discharging the medium with the toner image thus fixed thereto to outside the image forming apparatus 10; and a stack cover 63 for holding the medium thus discharged.

As shown in FIG. 2, the developing device 11 includes a toner storage portion 12 as a storage portion for storing the toner 30; a toner supply roller 13; a developing roller 14; a photosensitive drum 15 as an image supporting member; a charge roller 52; a cleaning blade 53; and an exposure head 54.

In the embodiment, the charge roller 52 functions as a charge device for uniformly and evenly charging the photosensitive drum 15 rotating. The exposure head 54 includes an LED (Light Emitting Diode) head and the likes for irradiating a surface of the photosensitive drum 15 according to an image signal, so that the surface of the photosensitive drum 15 is selectively exposed to form a static latent image thereon.

In the embodiment, the developing roller 14 attaches the toner 30 to the surface of the photosensitive drum 15 with the static latent image formed thereon, thereby forming the toner image. The toner supply roller 13 supplies the toner 30 onto the developing roller 14.

In the embodiment, the transfer belt 59 transfers the toner image formed on the surface of the photosensitive drum 15 to the medium through a static force. The cleaning blade 53 has an end portion abutting against the surface of the photosensitive drum 15 for removing the toner 30 remaining on the surface of the photosensitive drum 15. A cleaning arm 23 is disposed in the toner storage portion 12 as a rotational member rotating in an arrow direction.

Figure 1:
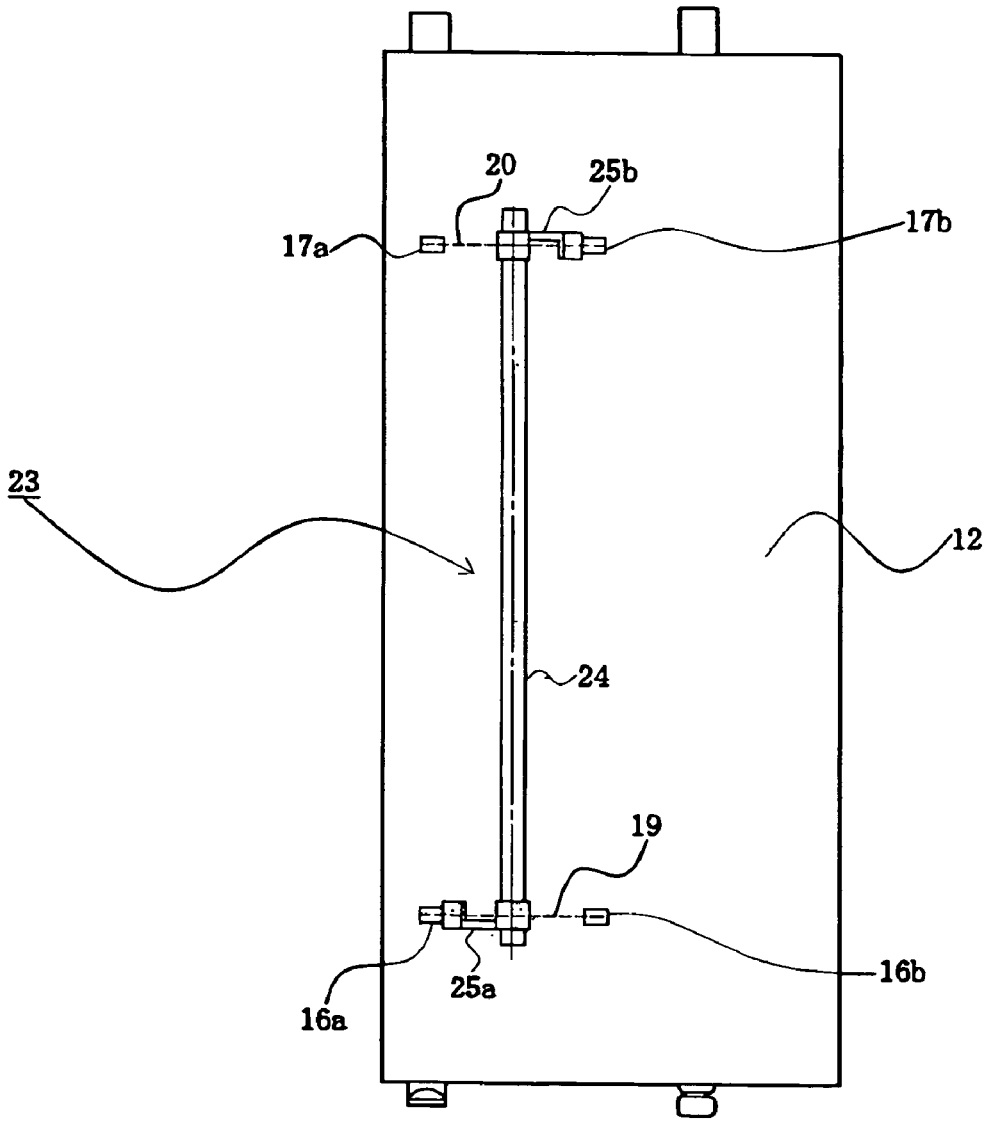
FIG. 1 is a schematic plan view showing a developing device according to a first embodiment of the present invention.

A configuration of the toner storage portion 12 will be explained in more detail next. FIG. 1 is a schematic plan view showing the developing device 11 according to the first embodiment of the present invention.

Figure 4:
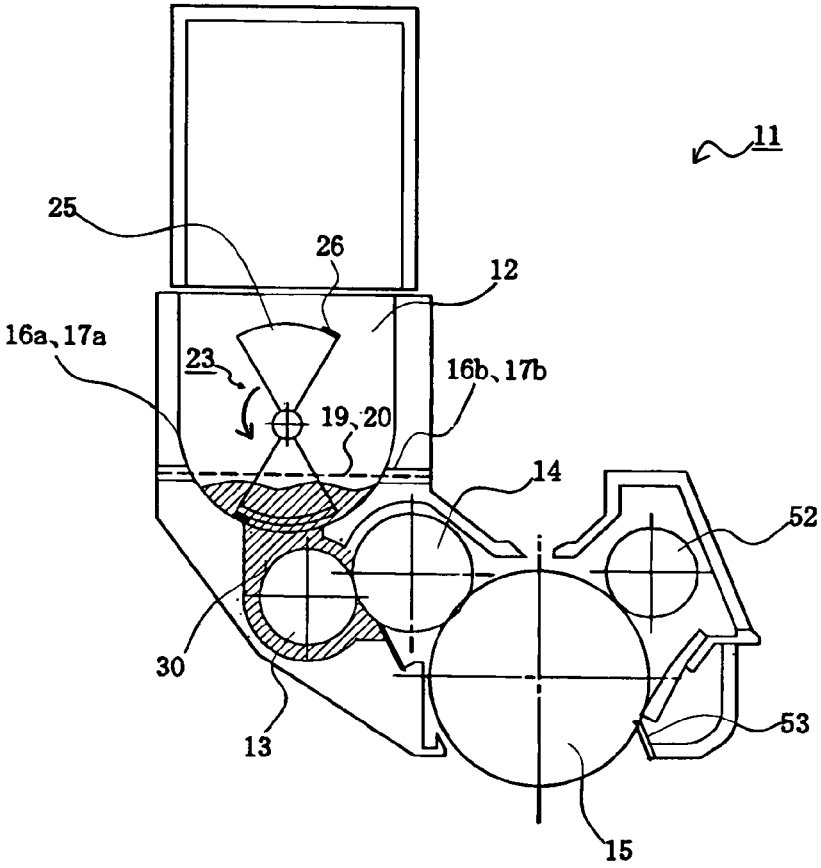
FIG. 4 is a schematic side sectional view showing the developing device according to the first embodiment of the present invention.
Figure 5:
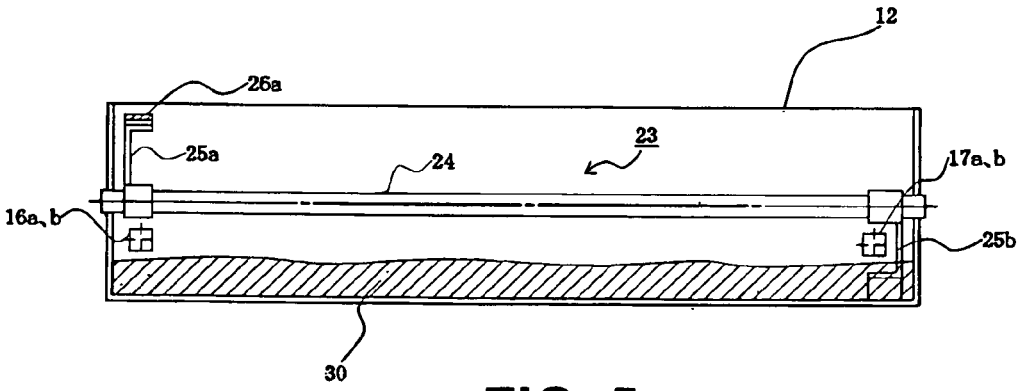
FIG. 5 is a schematic front sectional view showing the developing device according to the first embodiment of the present invention.
Figure 6:
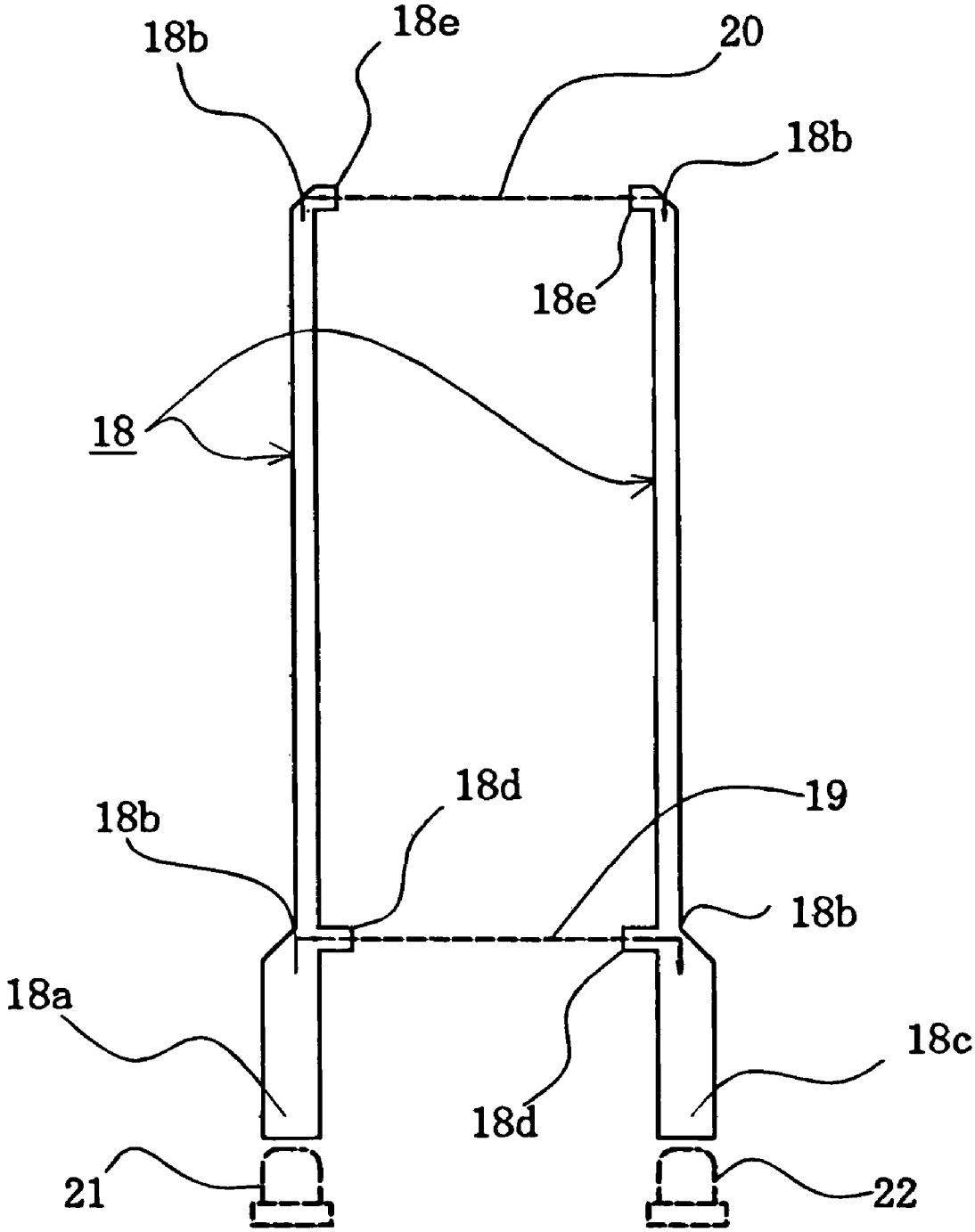
FIG. 6 is a plan view showing a light guide member of the developing device according to the first embodiment of the present invention.

FIG. 4 is a schematic side sectional view showing the developing device 11 according to the first embodiment of the present invention. FIG. 5 is a schematic front sectional view showing the developing device 11 according to the first embodiment of the present invention. FIG. 6 is a plan view showing a light guide member 18 of the developing device 11 according to the first embodiment of the present invention.

In the embodiment, a pair of optical sensors, that is, a light-emitting element 21 and a light-receiving element 22, is provided for detecting a remaining amount of the toner 30 stored in the toner storage portion 12. A plurality of optical paths, that is, a first optical path 19 and a second optical path 20, is set in the toner storage portion 12. More specifically, the first optical path 19 and the second optical path 20 are set at a lower portion of the toner storage portion 12 near both end portions of the toner storage portion 12 in a width direction thereof.

In the embodiment, a pair of first window holes 16*a* and 16*b* is formed in a wall surface of the toner storage portion 12 at the lower portion of the toner storage portion 12 near the both end portions of the toner storage portion 12 in the width direction thereof for forming the first optical path 19. Similarly, a pair of second window holes 17*a* and 17*b* is formed in the wall surface of the toner storage portion 12 at the lower portion of the toner storage portion 12 near the both end portions of the toner storage portion 12 in the width direction thereof for forming the second optical path 20.

Note that the first window holes 16*a* and 16*b* and the second window holes 17*a* and 17*b* are located at a same position in a vertical direction. At the position, when a remaining amount of the toner 30 becomes smaller than a specific amount, the toner 30 no longer block the first optical path 19 and the second optical path 20.

As shown in FIG. 6, the light guide member 18 has a pair of first protruding ends 18*d* and a pair of second protruding ends 18*e*. The first protruding ends 18*d* are fitted in the first window holes 16*a* and 16*b*, respectively. The second protruding ends 18*e* are fitted in the second window holes 17*a* and 17*b*, respectively. The first protruding ends 18*d* are formed near base portions of the light guide member 18, and the second protruding ends 18*e* are formed near distal end portions of the light guide member 18.

In the embodiment, light outgoes from one of the first protruding ends 18*d* and enters the other of the first protruding ends 18*d* along the first optical path 19. Similarly, light outgoes from one of the second protruding ends 18*e* and enters the other of the second protruding ends 18*e* along the second optical path 20.

In the embodiment, a light incident surface 18*a* is formed on one of the base portions of the light guide member 18, and the light-emitting element 21 is disposed to face the light incident surface 18*a*. Further, a light radiation surface 18*c* is formed on the other of the base portions of the light guide member 18, and the light-receiving element 22 is disposed to face the light radiation surface 18*c*. A control unit (not shown) is connected to the light-emitting element 21 and the light-receiving element 22 for processing a signal therefrom.

In the embodiment, the light guide member 18 is formed of a transparent material such as polycarbonate. In the light guide member 18, light emitting from the light-emitting element 21 is divided into two optical axes, so that light outgoes from one of the first protruding ends 18*d* and one of the second protruding ends 18*e*. Then, the light guide member 18 collects light entering the other of the first protruding ends 18*d* and the other of the second protruding ends 18*e*, and guides light to the light-receiving element 22.

In the embodiment, light entering through the light incident surface 18*a* proceeds straight through the light guide member 18, and is reflected on reflection surfaces 18*b*, so that light outgoes from one of the first protruding ends 18*d* and one of the second protruding ends 18*e*. Then, light entering the other of the first protruding ends 18*d* and the other of the second protruding ends 18*e* is reflected on reflection surfaces 18*b*, so that light proceeds straight through the light guide member 18 and is received with the light-receiving element 22.

In the embodiment, the cleaning arm 23 is disposed in the toner storage portion 12. The cleaning arm 23 includes a shaft 24 extending in the width direction of the toner storage portion 12 and supported on both end surfaces of the toner storage portion 12 to be rotatable; a first arm 25*a* and a second arm 25*b* as a cleaning member attached to both end portions of the shaft 24 and extending in a radial direction; and a first cleaning pad 26*a* and a second cleaning pad 26*b* respectively disposed at outer circumferential surfaces of the first arm 25*a* and the second arm 25*b* for cleaning the first protruding ends 18*d* and the second protruding ends 18*e* of the light guide member 18 fitted into the first window holes 16*a* and 16*b* and the second window holes 17*a* and 17*b*.

Figure 7:
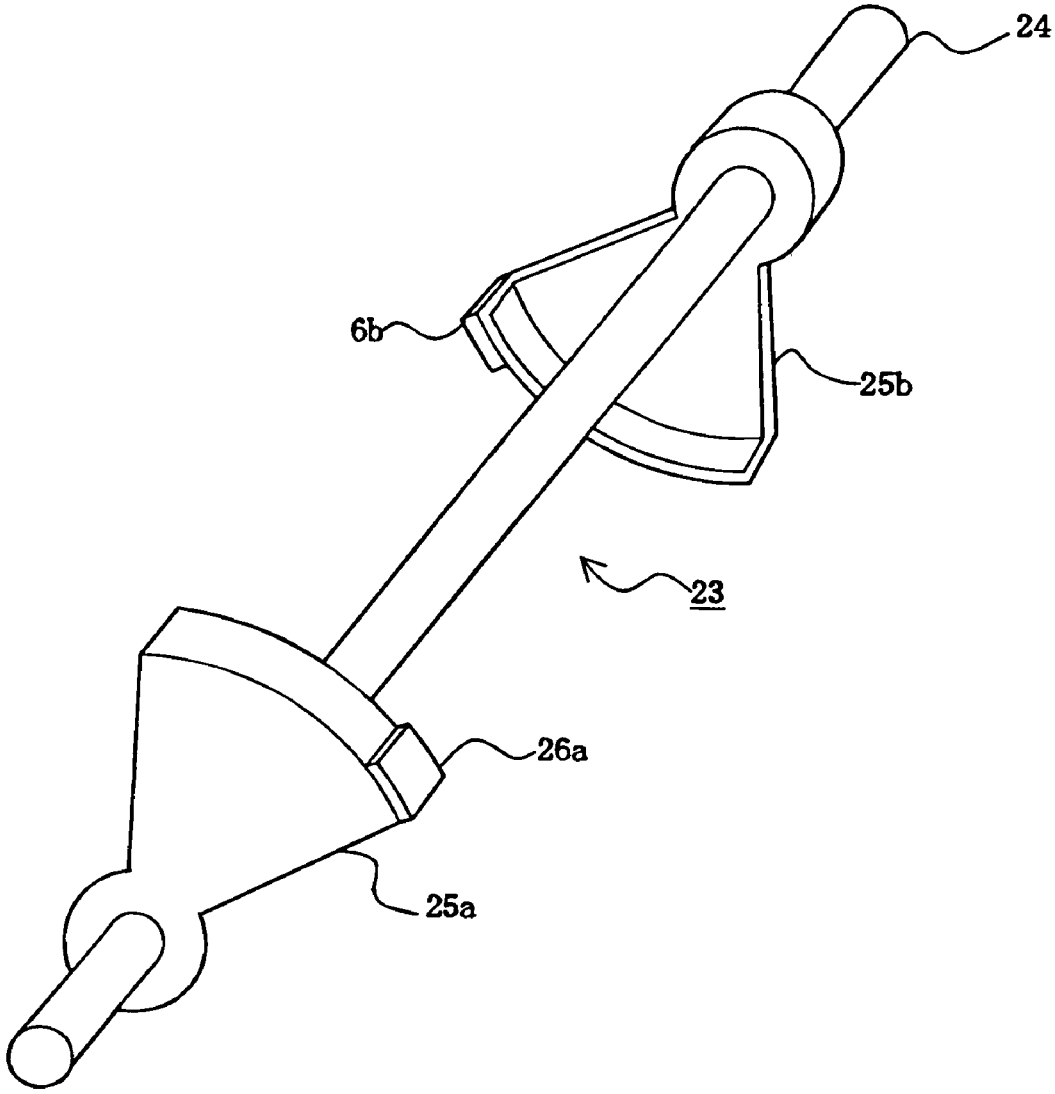
FIG. 7 is a perspective view showing a cleaning arm of the developing device according to the first embodiment of the present invention.
Figure 8:
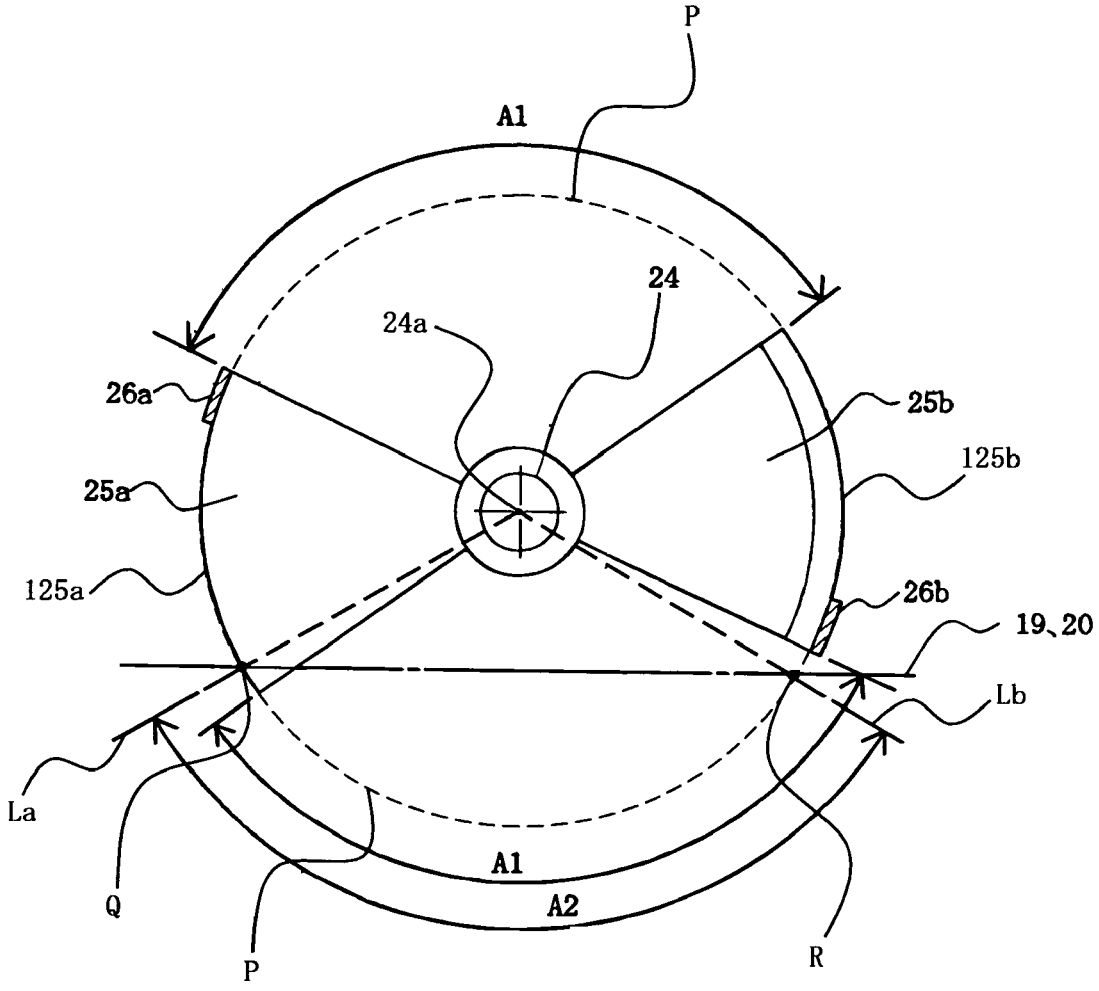
FIG. 8 is a schematic view showing a positional relationship between the cleaning arm and an optical path according to the first embodiment of the present invention.

A configuration of the cleaning arm 23 will be explained in more detail next. FIG. 7 is a perspective view showing the cleaning arm 23 of the developing device 11 according to the first embodiment of the present invention. FIG. 8 is a schematic view showing a positional relationship between the cleaning arm 23 and the optical path according to the first embodiment of the present invention.

As shown in FIG. 7, the first arm 25*a* and the second arm 25*b* are attached to the shaft 24 at angles shifted with each other. More specifically, the first arm 25*a* and the second arm 25*b* are attached to the shaft 24, so that the first arm 25*a* and the second arm 25*b* have phases shifted with each other in a rotational direction.

In the embodiment, when the shaft 24 rotates, the first arm 25*a* and the second arm 25*b* periodically block detection light passing through the first optical path 19 and the second optical path 20. As described above, the first arm 25*a* and the second arm 25*b* have phases shifted with each other in the rotational direction. Accordingly, a phase of the first arm 25*a* blocking the first optical path 19 is different from a phase of the second arm 25*b* blocking the second optical path 20.

As shown in FIG. 8, an edge surface 125*a* of the first arm 25*a* and an edge surface 125*b* of the second arm 25*b* rotate along a rotational path P. The rotational path P crosses the first optical path 19 and the second optical path 20 at crossing points Q and R, respectively.

In this case, a line La extending from the crossing point Q to a rotational axis 24*a* of the shaft 24 has an angle A2 with respect to a line Lb extending from the crossing point R to the rotational axis 24*a* of the shaft 24. The first arm 25*a* and the second arm 25*b* are attached to the shaft 24 with an angle A1. In the embodiment, it is arranged such that the angle A1 is smaller than the angle A2 (A1<A2).

In the embodiment, the first cleaning pad 26*a* and the second cleaning pad 26*b* are disposed at the outer circumferential surfaces of the first arm 25*a* and the second arm 25*b*. When the cleaning arm 23 rotates, the first cleaning pad 26*a* and the second cleaning pad 26*b* move over the first window holes 16*a* and 16*b* and the second window holes 17*a* and 17*b*. At this time, the first cleaning pad 26*a* and the second cleaning pad 26*b* remove the toner 30 and clean the first protruding ends 18*d* and the second protruding ends 18*e* of the light guide member 18 fitted into the first window holes 16*a* and 16*b* and the second window holes 17*a* and 17*b*.

In the embodiment, the first cleaning pad 26*a* and the second cleaning pad 26*b* are preferably formed of an ester type sponge, and may be formed of a member such as a felt, a film, and the likes.

An operation of the developing device 11 will be explained next. First, as shown in FIG. 2, when a drive gear (not shown) drives the cleaning arm 23 to rotate in the arrow direction, the toner supply roller 13 rotates, so that the toner 30 is taken with the toner supply roller 13. After the toner 30 is coated on the surface of the developing roller 14 through the toner supply roller 13, the toner 30 adheres to the static latent image formed in advance on the surface of the photosensitive drum 15 as the latent image, thereby developing the static latent image as the toner image.

At the same time, in the toner storage portion 12, the first cleaning pad 26*a* and the second cleaning pad 26*b* respectively attached to the first arm 25*a* and the second arm 25*b* of the cleaning arm 23 are rubbed against the first protruding ends 18*d* and the second protruding ends 18*e* of the light guide member 18 fitted into the first window holes 16*a* and 16*b* and the second window holes 17*a* and 17*b*. Accordingly, the first cleaning pad 26*a* and the second cleaning pad 26*b* remove the toner 30 and clean the first protruding ends 18*d* and the second protruding ends 18*e* of the light guide member 18.

When a sufficient amount of the toner 30 remains in the toner storage portion 12, the toner 30 is filled in the toner storage portion 12 up to a level above the first optical path 19 and the second optical path 20. Accordingly, even when the first cleaning pad 26*a* and the second cleaning pad 26*b* remove the toner 30 and clean the first protruding ends 18*d* and the second protruding ends 18*e* of the light guide member 18, the toner 30 covers the first protruding ends 18*d* and the second protruding ends 18*e* of the light guide member 18 fitted into the first window holes 16*a* and 16*b* and the second window holes 17*a* and 17*b*. As a result, the toner 30 blocks the first optical path 19 and the second optical path 20, so that the light-receiving element 22 does not receive light.

Figure 9:
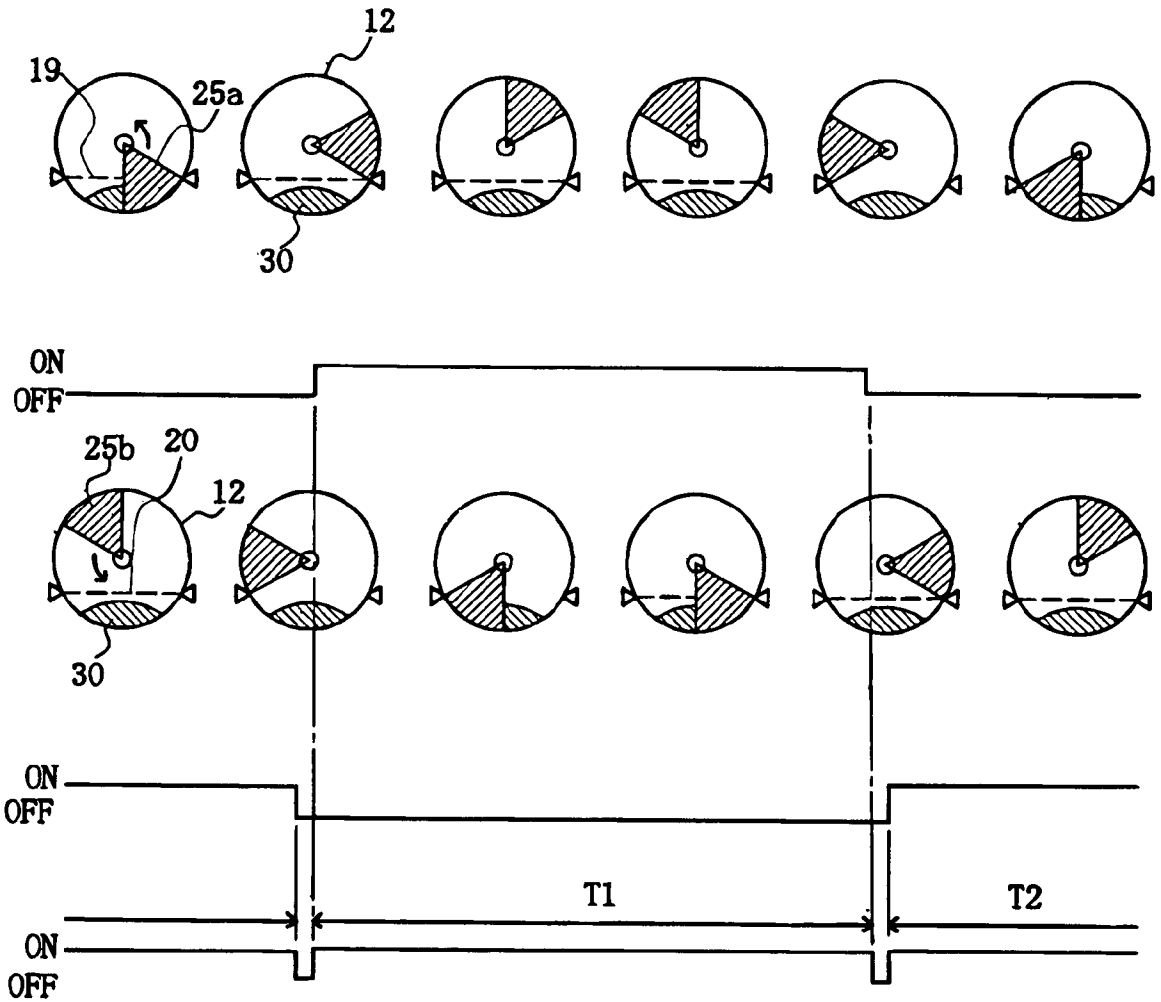
FIGS. 9(*a*) to 9(*e*) are charts showing a positional relationship between the cleaning arm and a detection signal of a light-receiving element according to the first embodiment of the present invention, wherein FIG. 9(*a*) is a chart showing a positional relationship between a first arm and a first optical path, FIG. 9(*b*) is a chart showing a change in detection light passing through the first optical path, FIG. 9(*c*) is a chart showing a positional relationship between a second arm and a second optical path, FIG. 9(*d*) is a chart showing a change in detection light passing through the second optical path, and FIG. 9(*e*) is a chart showing a change in detection light received at the light-receiving element.

When the image forming apparatus 10 is continued to use, a remaining amount of the toner 30 in the toner storage portion 12 decreases. FIGS. 9(*a*) to 9(*e*) are charts showing a positional relationship between the cleaning arm 23 and the detection signal of the light-receiving element 22 according to the first embodiment of the present invention. In FIGS. 9(*a*) to 9(*e*), a horizontal direction represents a period of time.

More specifically, FIG. 9(*a*) is a chart showing a positional relationship between the first arm 25*a* and the first optical path 19; FIG. 9(*b*) is a chart showing a change in detection light passing through the first optical path 19; FIG. 9(*c*) is a chart showing a positional relationship between the second arm 25*b* and the second optical path 20; FIG. 9(*d*) is a chart showing a change in detection light passing through the second optical path 20; and FIG. 9(*e*) is a chart showing a change in detection light received at the light-receiving element 22.

As shown in FIGS. 9(*a*) and 9(*b*), when the first arm 25*a* does not block the first optical path 19, detecting light passing through the first optical path 19 is turned on. That is, the light-receiving element 22 detects detection light passing through the first optical path 19.

As shown in FIGS. 9(*c*) and 9(*d*), when the second arm 25*b* does not block the second optical path 20, detecting light passing through the second optical path 20 is turned on. That is, the light-receiving element 22 detects detection light passing through the second optical path 20.

As shown in FIG. 9(*e*), when the light-receiving element 22 detects detection light passing through the first optical path 19 or the second optical path 20, that is, the light-receiving element 22 is turned on, the states that detecting light is turned on in FIGS. 9(*a*) and 9(*c*) are overlapped. In this state, the light-receiving element 22 detects detection light passing through either of the first optical path 19 or the second optical path 20.

In the embodiment, the first arm 25*a* and the second arm 25*b* are attached to the shaft 24 at angles shifted with each other. Further, the first arm 25*a* or the second arm 25*b* blocks one of the first optical path 19 and the second optical path 20 all the time. Accordingly, the detection signal (a detection time T1) of detection light passing through the first optical path 19 has a detection wave shifted in terms of time with respect to that of the detection signal (a detection time T2) of detection light passing through the second optical path 20. That is, the detection signal (the detection time T1) of detection light passing through the first optical path 19 is not overlapped with the detection signal (the detection time T2) of detection light passing through the second optical path 20.

When the toner 30 stored in the toner storage portion 12 has an uneven distribution, the light-receiving element 22 first detects detection light passing through an optical path on a side where a remaining amount of the toner 30 is smaller. When an amount of detection light passing through the first optical path 19 or the second optical path 20 becomes smaller than a specific level, the control unit determines that the toner 30 is run out, and notifies a user of the image forming apparatus 10 through a display unit (not shown).

In the embodiment, the first arm 25*a* and the second arm 25*b* are attached to the shaft 24 at angles shifted with each other, so that the first arm 25*a* and the second arm 25*b* block the first optical path 19 and the second optical path 20 at the same time when the blocked optical path is switched. Accordingly, there is always an OFF signal between the detection time T1 and the detection time T2. That is, there is always no ON signal between the detection time T1 and the detection time T2. With the OFF signal, it is possible to confirm whether the cleaning arm 23 rotates normally.

As described above, in the embodiment, a remaining amount of the toner 30 is detected at a plurality of locations in the toner storage portion 12. Accordingly, it is possible to accurately detect a remaining amount of the toner 30 even when the toner 30 stored in the toner storage portion 12 has an uneven distribution.

Further, in the embodiment, when the toner 30 stored in the toner storage portion 12 has an uneven distribution, it is possible to accordingly prompt a user to replace the toner cartridge. As a result, as compared with the case in which a remaining amount of the toner 30 is detected at a single location in the toner storage portion 12, it is not necessary to set a margin in consideration of an uneven distribution of the toner 30, thereby not wasting the toner 30 in the toner storage portion 12.

Still further, in the embodiment, it is possible to detect a remaining amount of the toner 30 at a plurality of locations in the toner storage portion 12 with a pair of optical sensors. Accordingly, it is possible to reduce the number of parts.

Second Embodiment

A second embodiment of the present invention will be described below. In the description below, elements in the second embodiment similar to those in the first embodiment are designated by same reference numerals, and explanations thereof are omitted. Explanations of operations and effects in the second embodiment similar to those in the first embodiment are omitted.

Figure 10:
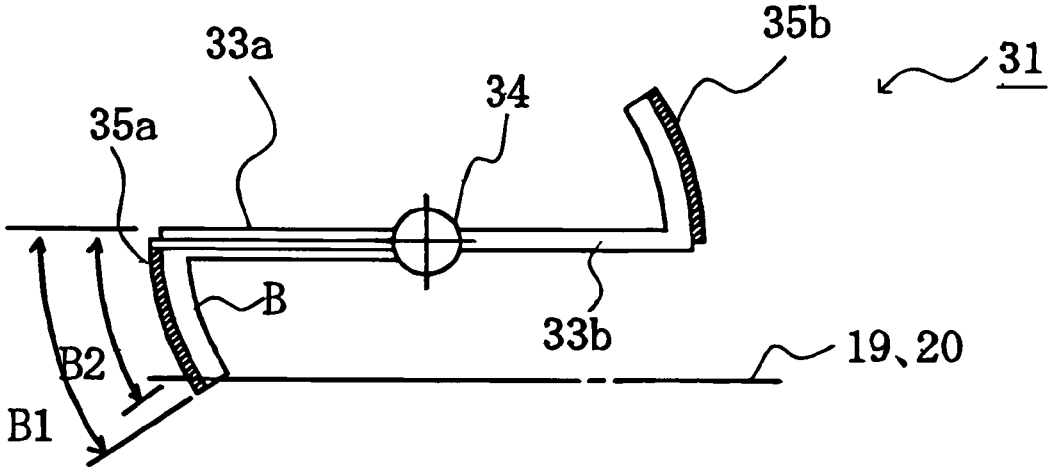
FIG. 10 is a schematic side view showing a toner stirring member according to a second embodiment of the present invention.
Figure 11:
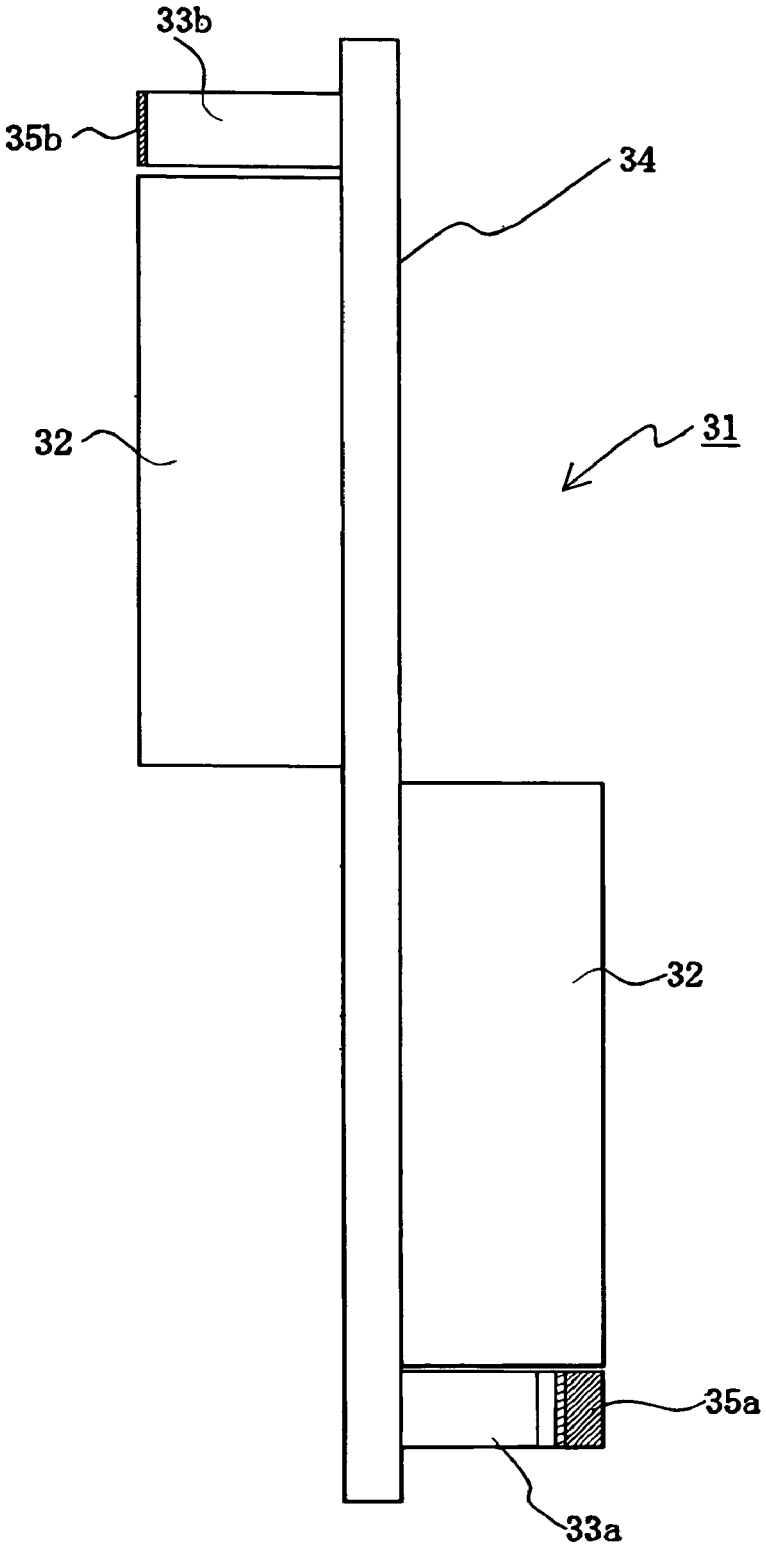
FIG. 11 is a schematic plan view showing the toner stirring member according to the second embodiment of the present invention.

FIG. 10 is a schematic side view showing a toner stirring member 31 according to the second embodiment of the present invention. FIG. 11 is a schematic plan view showing the toner stirring member 31 according to the second embodiment of the present invention.

In the embodiment, the toner stirring member 31 is provided as a rotational member. As shown in FIG. 10, the toner stirring member 31 includes a stirring shaft 34 extending in the width direction of the toner storage portion 12 and supported on the both end walls of the toner storage portion 12 to be rotatable; a first arm 33*a* and a second arm 33*b* as a cleaning member attached to the stirring shaft 34 near both end portions thereof and extending in a radial direction; a first cleaning pad 35*a* and a second cleaning pad 35*b* respectively disposed at outer circumferential surfaces of the first arm 33*a* and the second arm 33*b* for cleaning the first protruding ends 18*d* and the second protruding ends 18*e* of the light guide member 18 fitted into the first window holes 16*a* and 16*b* and the second window holes 17*a* and 17*b*; and a stirring sheet 32 with a sheet shape attached to the stirring shaft 34 and extending in the radial direction.

As shown in FIG. 10, the first arm 33*a* and the second arm 33*b* are attached to the stirring shaft 34 with reversed phases with each other. The first arm 33*a* and the second arm 33*b* have arc portions B situated along the inner wall of the toner storage portion 12 when the toner stirring member 31 is attached to the toner storage portion 12.

In the embodiment, the arc portions B have an angle B1, and the first optical path 19 and the second optical path 20 have an angle B2 with respect to the stirring shaft 34. It is configured such that the angle B1 is larger than the angle B2 (B1>B2). Accordingly, when the toner stirring member 31 rotates, at least one of the first arm 33*a* and the second arm 33*b* always blocks one of the first optical path 19 and the second optical path 20.

In the embodiment, the first cleaning pad 35*a* and the second cleaning pad 35*b* are disposed at the outer circumferential surfaces of the first arm 33*a* and the second arm 33*b*, respectively. When the toner stirring member 31 rotates, the first cleaning pad 35*a* and the second cleaning pad 35*b* move over the first window holes 16*a* and 16*b* and the second window holes 17*a* and 17*b*, respectively. At this time, the first cleaning pad 35*a* and the second cleaning pad 35*b* remove the toner 30 and clean the first protruding ends 18*d* and the second protruding ends 18*e* of the light guide member 18 fitted into the first window holes 16*a* and 16*b* and the second window holes 17*a* and 17*b*.

In the embodiment, the first cleaning pad 35*a* and the second cleaning pad 35*b* have a length smaller than that of the first window holes 16*a* and 16*b* and the second window holes 17*a* and 17*b*. Accordingly, when the first cleaning pad 35*a* and the second cleaning pad 35*b* slide against the inner wall of the toner storage portion 12, it is possible to reduce a rotational load due to friction.

In the embodiment, the first cleaning pad 35*a* and the second cleaning pad 35*b* are preferably formed of a urethane rubber, a polyester film, and the likes with rigidity and wear resistance.

Figure 12:
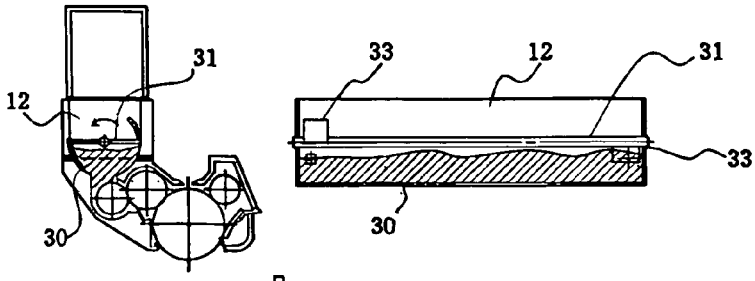
FIGS. 12(*a*) to 12(*e*) are schematic views showing an operation of the toner stirring member according to the second embodiment of the present invention.
Figure 12:
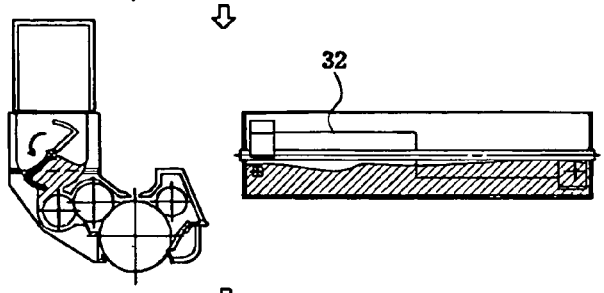
Figure 12:
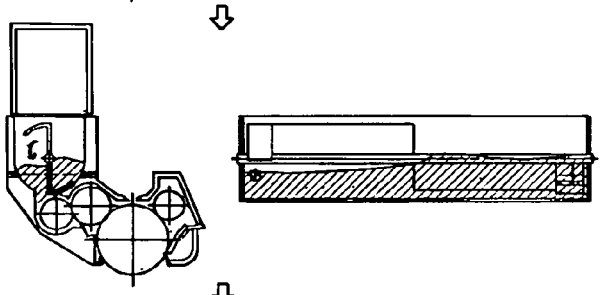
Figure 12:
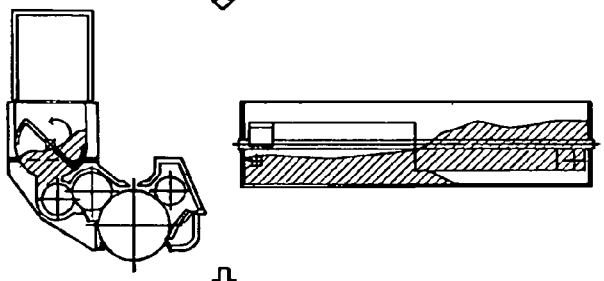
Figure 12:
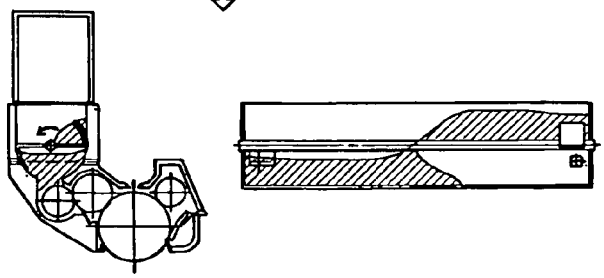

An operation of the toner stirring member 31 will be explained next. FIGS. 12(*a*) to 12(*e*) are schematic views showing the operation of the toner stirring member 31 according to the second embodiment of the present invention. FIGS. 12(*a*) to 12(*e*) show a change in a state of the toner 30 with time while the toner stirring member 31 is rotating.

In the second embodiment, the operation of the toner stirring member 31 is similar to that of the cleaning arm 23 in the first embodiment. In the second embodiment, the first arm 33*a* and the second arm 33*b* have a shape different from that of the first arm 25*a* and the second arm 25*b* in the first embodiment. Further, in the second embodiment, the stirring sheet 32 is provided for stirring a whole portion of the toner 30 in the toner storage portion 12.

In general, the toner 30 tends to lose flowability thereof with time. In the embodiment, the stirring sheet 32 is provided for stirring the toner 30, thereby preventing the toner 30 from losing flowability thereof.

As shown in FIG. 12, when the toner stirring member 31 rotates in an arrow direction, the first arm 33*a*, the second arm 33*b*, and the stirring sheet 32 sequentially stir up the toner 30.

When the image forming apparatus 10 is continued to use, a remaining amount of the toner 30 in the toner storage portion 12 decreases. A positional relationship between the remaining amount of the toner 30 and the toner stirring member 31 will be explained next. Further, a relationship of the detection signal at the light-receiving element 22 will be explained.

Figure 13:
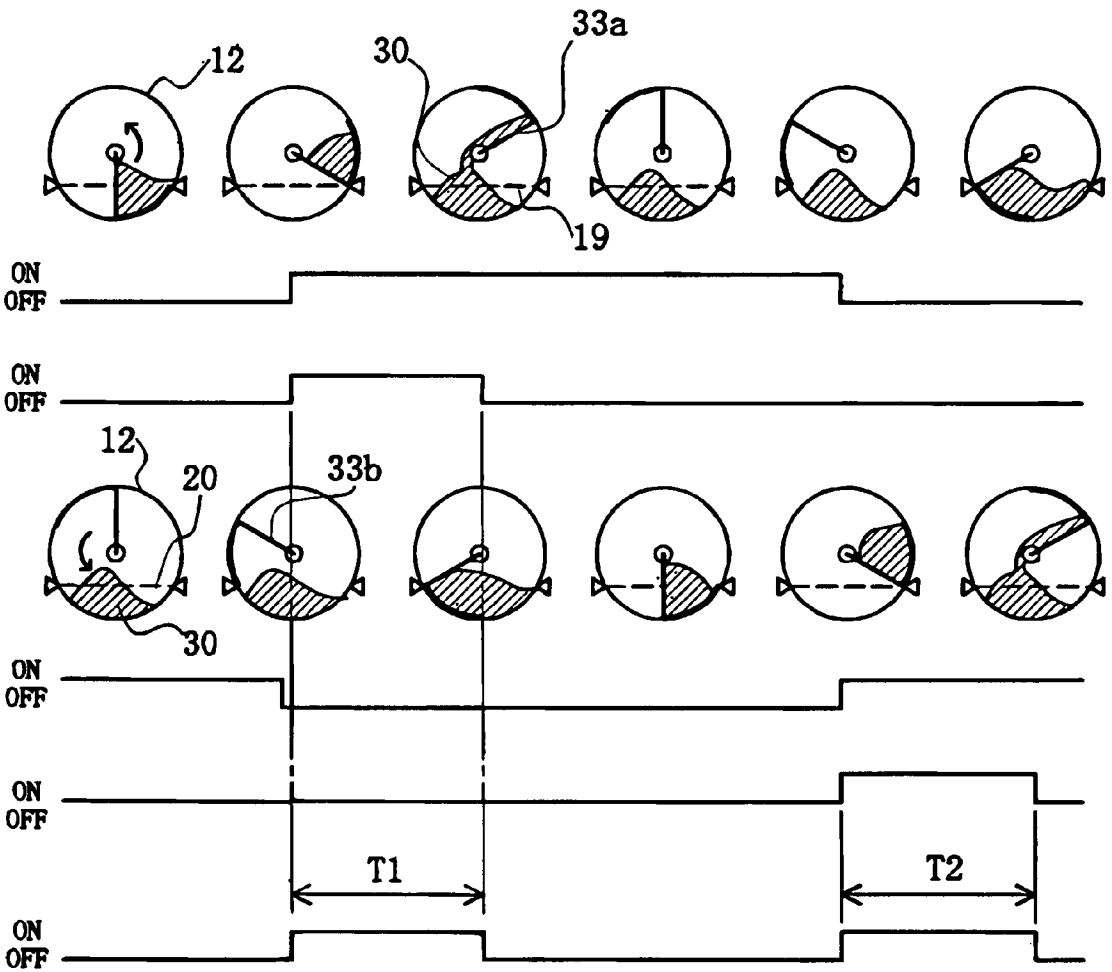
FIGS. 13(*a*) to 13(*g*) are charts showing a positional relationship between a cleaning arm and a detection signal of a light-receiving element in a state that toner decreases according to the second embodiment of the present invention, wherein FIG. 13(*a*) is a chart showing a positional relationship between a first arm and a first optical path, FIG. 13(*b*) is a chart showing a change in detection light entering the first optical path, FIG. 13(*c*) is a chart showing a change in detection light outgoing from the first optical path, FIG. 13(*d*) is a chart showing a positional relationship between a second arm and a second optical path, FIG. 13(*e*) is a chart showing a change in detection light entering the second optical path, FIG. 13(*f*) is a chart showing a change in detection light outgoing from the second optical path, and FIG. 13(*g*) is a chart showing a change in detection light received at the light-receiving element.
Figure 14:
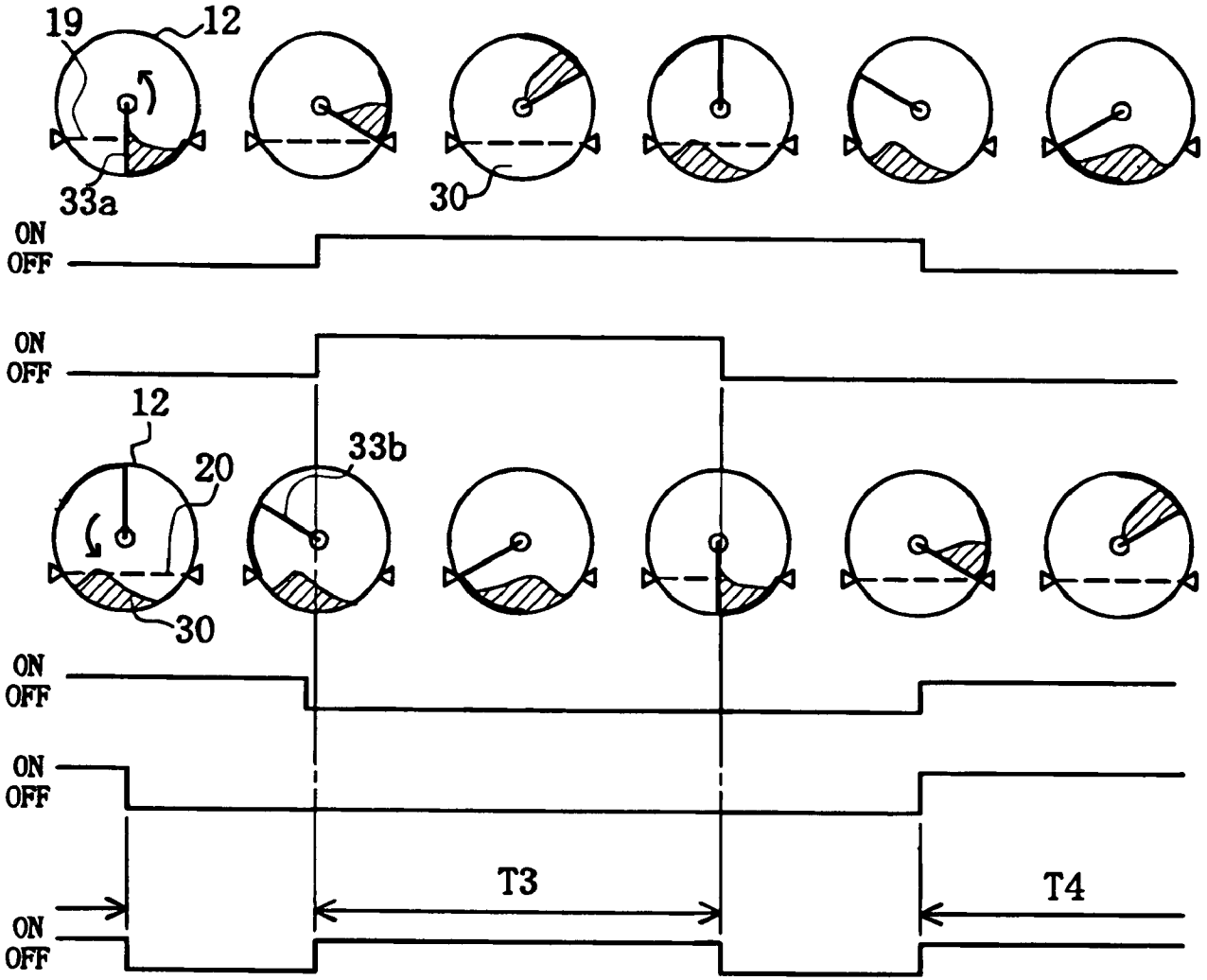
FIGS. 14(*a*) to 14(*g*) are charts showing the positional relationship between the cleaning arm and the detection signal of the light-receiving element in a state that toner further decreases according to the second embodiment of the present invention, wherein FIG. 14(*a*) is a chart showing a positional relationship between the first arm and the first optical path, FIG. 14(*b*) is a chart showing a change in detection light entering the first optical path, FIG. 14(*c*) is a chart showing a change in detection light outgoing from the first optical path, FIG. 14(*d*) is a chart showing a positional relationship between the second arm and the second optical path, FIG. 14(*e*) is a chart showing a change in detection light entering the second optical path, FIG. 14(*f*) is a chart showing a change in detection light outgoing from the second optical path, and FIG. 14(*g*) is a chart showing a change in detection light received at the light-receiving element.
Figure 15:
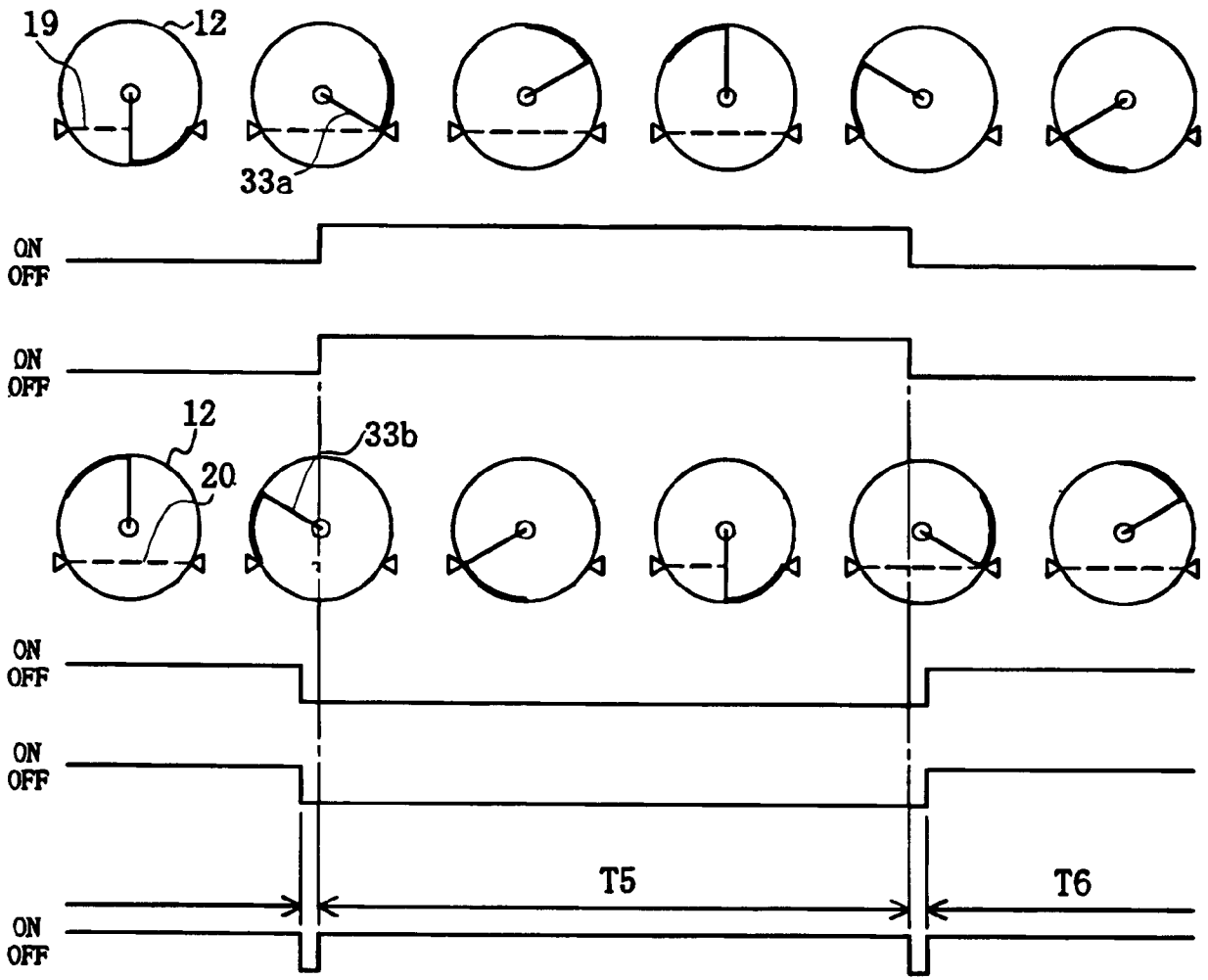
FIGS. 15(*a*) to 15(*g*) are charts showing the positional relationship between the cleaning arm and the detection signal of the light-receiving element in a state that toner is completely consumed according to the second embodiment of the present invention, wherein FIG. 15(*a*) is a chart showing a positional relationship between the first arm and the first optical path, FIG. 15(*b*) is a chart showing a change in detection light entering the first optical path, FIG. 15(*c*) is a chart showing a change in detection light outgoing from the first optical path, FIG. 15(*d*) is a chart showing a positional relationship between the second arm and the second optical path, FIG. 15(*e*) is a chart showing a change in detection light entering the second optical path, FIG. 15(*f*) is a chart showing a change in detection light outgoing from the second optical path, and FIG. 15(*g*) is a chart showing a change in detection light received at the light-receiving element.

FIGS. 13(*a*) to 13(*g*) are charts showing the positional relationship between the cleaning arm 31 and the detection signal of the light-receiving element 22 in a state that the toner 30 decreases according to the second embodiment of the present invention. FIGS. 14(*a*) to 14(*g*) are charts showing the positional relationship between the cleaning arm 31 and the detection signal of the light-receiving element 22 in a state that the toner 30 further decreases according to the second embodiment of the present invention. FIGS. 15(*a*) to 15(*g*) are charts showing the positional relationship between the cleaning arm 31 and the detection signal of the light-receiving element 22 in a state that the toner 30 is completely consumed according to the second embodiment of the present invention.

More specifically, in each of the states of the toner 30, FIGS. 13(*a*), 14(*a*), and 15(*a*) are charts showing positional relationships between the first arm 33*a* and the first optical path 19; FIGS. 13(*b*), 14(*b*), and 15(*b*) are charts showing changes in detection light entering the first optical path 19, FIGS. 13(*c*), 14(*c*), and 15(*c*) are charts showing changes in detection light outgoing from the first optical path 19; FIGS. 13(*d*), 14(*d*), and 15(*d*) are charts showing positional relationships between the second arm 33*b* and the second optical path 20; FIGS. 13(*e*), 14(*e*), and 15(*e*) are charts showing changes in detection light entering the second optical path 20; FIGS. 13(*f*), 14(*f*), and 15(*f*) are charts showing changes in detection light outgoing from the second optical path 20; and FIGS. 13(*g*), 14(*g*), and 15(*g*) are charts showing changes in detection light received at the light-receiving element 22.

In FIGS. 13(*a*) to 13(*g*), FIGS. 14(*a*) to 14(*g*), FIGS. 15(*a*) to 15(*g*), a horizontal direction represents a period of time.

As shown in FIG. 13(*g*), when the light-receiving element 22 detects detection light passing through the first optical path 19 or the second optical path 20, that is, the light-receiving element 22 is turned on, the states that detecting light is turned on in FIGS. 13(*c*) and 13(*f*) are overlapped. In this state, the light-receiving element 22 detects detection light passing through either of the first optical path 19 or the second optical path 20.

In the embodiment, the first arm 33*a* and the second arm 33*b* are attached to the stirring shaft 34 at the inversed phases with each other. Accordingly, the detection signal (a detection time T1) of detection light passing through the first optical path 19 is shifted from and is not overlapped with the detection signal (a detection time T2) of detection light passing through the second optical path 20. As a result, as the remaining amount of the toner 30 decreases, the detection time T1 of the detection signal of detection light passing through the first optical path 19 and the detection time T2 of the detection signal of detection light passing through the second optical path 20 increase.

FIGS. 14(*a*) to 14(*g*) show the state that the toner 30 further decreases from the state shown in FIGS. 13(*a*) to 13(*g*). In this state, when the first arm 33*a* and the second arm 33*b* scoop up the toner 30, the toner 30 tends to fall off from the first arm 33*a* and the second arm 33*b* more easily in a larger amount of the toner 30. Accordingly, the toner 30 blocks the first optical path 19 and the second optical path 20 more quickly. That is, when the toner 30 further decreases, a detection time T3 and a detection time T4 shown in FIG. 14(*g*) increase as opposed to the detection time T1 and the detection time T2 shown in FIG. 13(*g*).

When the toner 30 is completely consumed and the toner storage portion 12 becomes empty as shown in FIGS. 15(*a*) to 15(*g*), detection signals detected at the light-receiving element 22 are not overlapped as explained above.

In the embodiment, the first arm 33*a* and the second arm 33*b* always block one of the first optical path 19 and the second optical path 20. Accordingly, there is always an OFF signal between a detection time T5 and a detection time T6. When the OFF signal appears regularly, it is possible to detect the detection signal of detection light passing through the first optical path 19 or the second optical path 20 independently. Further, it is possible to confirm whether the toner stirring member 31 rotates normally.

As described above, in the embodiment, the first arm 33*a* and the second arm 33*b* have the specific shape capable of stirring the toner 30. Further, the stirring sheet 32 is arranged coaxially with the first arm 33*a* and the second arm 33*b*, thereby increasing flowability of the toner 30 in the toner storage portion 12. Accordingly, it is possible to accurately detect the toner 30 even though the toner 30 loses flowability with time.

Third Embodiment

A third embodiment of the present invention will be described below. In the description below, elements in the third embodiment similar to those in the first and second embodiments are designated by same reference numerals, and explanations thereof are omitted. Explanations of operations and effects in the third embodiment similar to those in the first and second embodiments are omitted.

Figure 16:
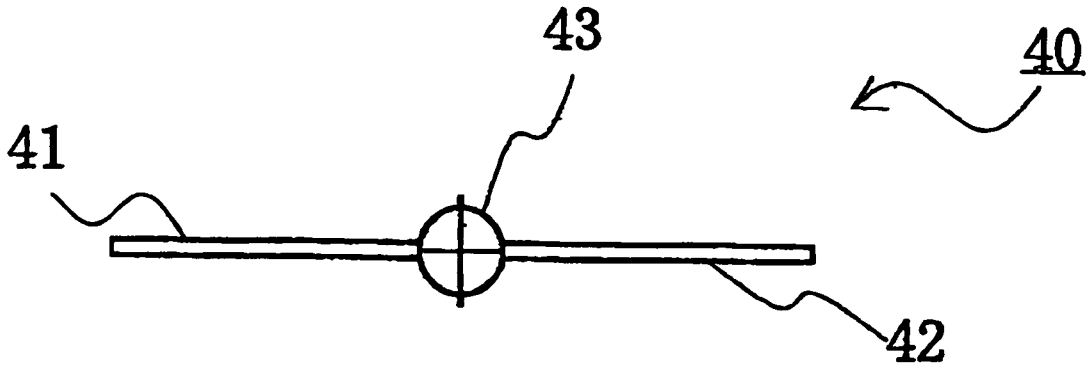
FIG. 16 is a schematic side view showing a toner stirring member according to a third embodiment of the present invention.
Figure 17:
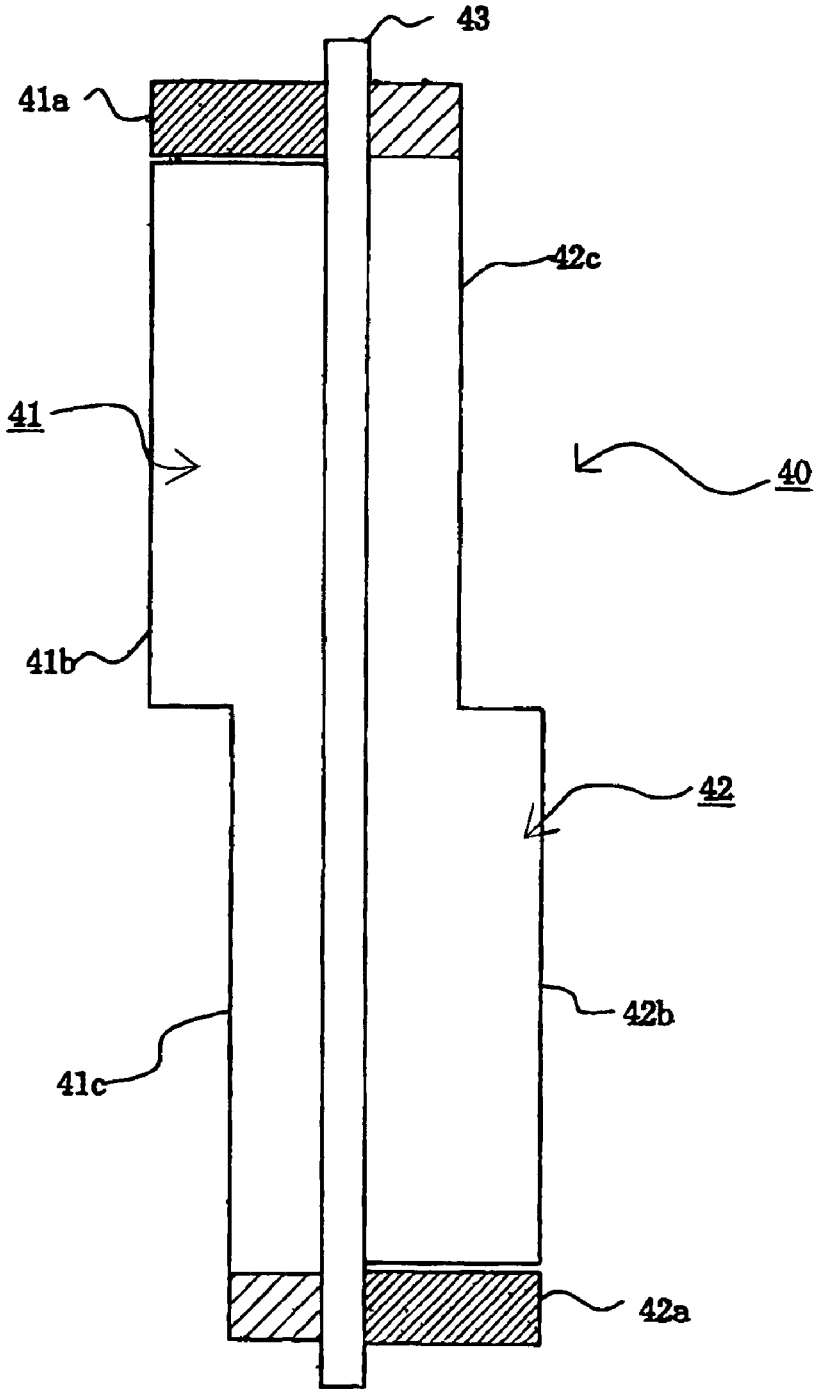
FIG. 17 is a schematic plan view showing the toner stirring member according to the third embodiment of the present invention.

FIG. 16 is a schematic side view showing a toner stirring member 40 according to the third embodiment of the present invention. FIG. 17 is a schematic plan view showing the toner stirring member 40 according to the third embodiment of the present invention.

In the embodiment, the toner stirring member 40 is provided as a rotational member. As shown in FIG. 16, the toner stirring member 40 includes a stirring shaft 43 extending in the width direction of the toner storage portion 12 and supported on the both end walls of the toner storage portion 12 to be rotatable; and a first stirring sheet 41 and a second stirring sheet 42 with a sheet shape attached to the stirring shaft 43 and extending in a radial direction.

In the embodiment, the first stirring sheet 41 and the second stirring sheet 42 are attached to the stirring shaft 43 with reversed phases with each other. Further, the first stirring sheet 41 and the second stirring sheet 42 respectively have first end portions 41*a* and 42*a* as a cleaning member, so that the first end portions 41*a* and 42*a* contact with the inner wall of the toner storage portion 12 when the toner stirring member 40 is attached to the toner storage portion 12.

In the embodiment, the first stirring sheet 41 and the second stirring sheet 42 further include second end portions 41*b* and 42*b*, respectively. The second end portions 41*b* and 42*b* have a length in the radial direction smaller than that of the first end portions 41*a* and 42*a*, so that the second end portions 41*b* and 42*b* do not contact with the inner wall of the toner storage portion 12. Accordingly, it is possible to reduce a rotational load generated upon contacting with the inner wall of the toner storage portion 12.

In the embodiment, the first stirring sheet 41 and the second stirring sheet 42 further include third end portions 41*c* and 42*c*, respectively. The third end portions 41*c* and 42*c* have a length such that the third end portions 41*c* and 42*c* block the first optical path 19 and the second optical path 20, respectively, when the toner stirring member 40 rotates.

In the embodiment, the first stirring sheet 41 and the second stirring sheet 42 have portions for blocking the first optical path 19 and the second optical path 20, respectively. The portions are indicated as hatched areas in FIG. 17, and are applied with color for preventing detection light from passing therethrough.

In the embodiment, the first stirring sheet 41 and the second stirring sheet 42 are preferably formed of a urethane rubber, a polyester film, and the likes with rigidity and wear resistance. An operation of the toner stirring member 40 is similar to that of the toner stirring member 31 in the second embodiment, and an explanation thereof is omitted.

As described above, in the third embodiment, as compared with the stirring sheet 31 of the toner stirring member 31 in the second embodiment, the third end portions 41*c* and 42*c* of the first stirring sheet 41 and the second stirring sheet 42 extend, respectively. Accordingly, when the toner stirring member 41 rotates at a speed same as that of the toner stirring member 31, it is possible to obtain a stirring effect doubled with respect to the toner stirring member 31 in the second embodiment.

Accordingly, as compared with the second embodiment, it is possible to improve flowability of the toner 30 to an extent equal to or greater that that in the second embodiment. As a result, it is possible to accurately detect a remaining amount of the toner 30. Further, it is possible to eliminate the first arm 33*a* and the second arm 33*b* in the second embodiment, thereby reducing the number of parts.

In the first to third embodiments, the first optical path 19 and the second optical path 20 are set inside the toner storage portion 12. It is possible to increase the number of the optical paths through adjusting the phase angle of the cleaning member.

Further, in the first to third embodiments, when one of the first optical path 19 and the second optical path 20 is detected first, the control unit notifies that the toner storage portion 12 is empty. Alternatively, it may be configured such that when both of the first optical path 19 and the second optical path 20 are detected, the control unit notifies that the toner storage portion 12 is empty. With the configuration, it is possible to reduce a variance generated when one of the first optical path 19 and the second optical path 20 is detected first, thereby improving accuracy. The configuration may be applicable to a developing device in which toner is not distributed unevenly.

In the embodiments described above, the two optical paths, i.e., the first optical path 19 and the second optical path 20, are provided for detecting toner. and three or more optical paths may be provided.

In the embodiments described above, the two optical paths, i.e., the first optical path 19 and the second optical path 20, are provided on the left and right side portions of the toner storage portion 12, and may be provided at other locations, for example, one side portion and one center portion of the toner storage portion 12.

In the embodiments described above, the two optical paths, i.e., the first optical path 19 and the second optical path 20, are provided along the longitudinal direction of the toner storage portion 12, and may be provided along a vertical direction of the toner storage portion 12.

The disclosure of Japanese Patent Application No. 2007-129977, filed on May 16, 2007, is incorporated in the application.

While the invention has been explained with reference to the specific embodiments of the invention, the explanation is illustrative and the invention is limited only by the appended claims.

What is claimed is:

1. A developing device comprising:

a storage portion for retaining developer, said storage portion being elongated in a longitudinal direction thereof;

a light guide member for forming a plurality of optical paths passing through the storage unit in parallel in a direction perpendicular to the longitudinal direction to detect an amount of the developer in the storage portion;

a plurality of window members formed in a wall of the storage portion for passing the optical paths therethrough;

a blocking member disposed to be movable for blocking the window members, said blocking member being disposed on each of the optical paths; and a drive unit for moving the blocking member so that the blocking member periodically blocks and opens each of the optical paths at different timings in a specific cycle when the drive unit moves the blocking member.

2. The developing device according to claim 1, wherein said drive unit includes a rotational member, said blocking member being disposed coaxially with the rotational member.

3. The developing device according to claim 1, further comprising a light emitting element for emitting light toward the light guide member and a light receiving element for receiving the light outgoing from the light guide member.

4. The developing device according to claim 1, wherein said light guide member is arranged to form a first optical path and a second optical path, said blocking member including a first blocking member for blocking and opening the first optical path and a second blocking member for blocking and opening the second optical path.

5. The developing device according to claim 4, wherein said drive unit is arranged to move the first blocking member and the second blocking member so that the first blocking member blocks the first optical path and the second blocking member opens the second optical path in a first period of time; the first blocking member opens the first optical path and the second blocking member blocks the second optical path in a second period of time shifted from the first period of time in the specific cycle; and the first blocking member blocks the first optical path and the second blocking member blocks the second optical path in a third period of time.

6. A developing device comprising:

a storage portion for retaining developer, said storage portion being elongated in a longitudinal direction thereof;

a light guide member for forming a plurality of optical paths passing through the storage unit in parallel in a direction perpendicular to the longitudinal direction to detect an amount of the developer in the storage portion;

a plurality of window members formed in a wall of the storage portion for passing the optical paths therethrough;

a blocking member disposed to be movable for blocking the window members, said blocking member being disposed on each of the optical paths; and a drive unit for moving the blocking member so that the blocking member periodically blocks and opens each of the optical paths with a specific phase difference when the drive unit moves the blocking member.

7. The developing device according to claim 6, wherein said drive unit includes a rotational member, said blocking member being disposed coaxially with the rotational member.

8. The developing device according to claim 6, further comprising a light emitting element for emitting light toward the light guide member and a light receiving element for receiving the light from the light guide member.

9. The developing device according to claim 6, wherein said light guide member is arranged to form a first optical path and a second optical path, said blocking member including a first blocking member for blocking and opening the first optical path and a second blocking member for blocking and opening the second optical path.

10. The developing device according to claim 9, wherein said drive unit is arranged to move the first blocking member and the second blocking member so that the first blocking member blocks the first optical path and the second blocking member opens the second optical path in a first period of time; the first blocking member opens the first optical path and the second blocking member blocks the second optical path in a second period of time shifted from the first period of time by the specific phase difference; and the first blocking member blocks the first optical path and the second blocking member blocks the second optical path in a third period of time.

11. An image forming apparatus comprising the developing device according to claim 1 detachably attached thereto.

12. An image forming apparatus comprising the developing device according to claim 6 detachably attached thereto.

* * * * *